US005253770A

United States Patent [19]

Rosenthal

[11] Patent Number: 5,253,770

[45] Date of Patent: Oct. 19, 1993

[54] MERCHANDISING UNIT

[75] Inventor: Gunter Rosenthal, St-Benoit, Canada

[73] Assignee: Rosenthal Import Ltd., Montreal, Canada

[21] Appl. No.: 813,594

[22] Filed: Dec. 26, 1991

[51] Int. Cl.[5] ..... A47F 3/00

[52] U.S. Cl. ..... 211/133; 211/88; 211/106

[58] Field of Search ..... 211/133, 88, 106, 181, 211/126; 160/353, 371, 351

[56] References Cited

U.S. PATENT DOCUMENTS

| | | | |
|---|---|---|---|
| 2,891,678 | 6/1959 | Levy | 211/126 |
| 2,970,702 | 2/1961 | Maslow | 211/181 X |
| 3,252,434 | 5/1966 | Young, Jr. | 211/181 X |
| 3,596,701 | 8/1971 | Cowan | 160/351 X |
| 3,834,324 | 9/1974 | Lang | 211/126 X |
| 4,018,340 | 4/1977 | Gold | 211/184 X |
| 4,127,196 | 11/1978 | Boucher | 160/351 X |
| 4,561,550 | 12/1985 | Franklin | 211/184 |
| 4,573,513 | 3/1986 | Small et al. | 160/351 X |
| 4,605,988 | 8/1986 | Nienhuis et al. | 211/126 X |
| 5,038,943 | 8/1991 | Reinke | 211/181 X |

FOREIGN PATENT DOCUMENTS

| | | | |
|---|---|---|---|
| 1262850 | 4/1961 | France | 211/133 |
| 228338 | 2/1925 | United Kingdom | 211/188 |
| 965495 | 7/1964 | United Kingdom | 211/126 |

*Primary Examiner*—Karen J. Chotkowski
*Attorney, Agent, or Firm*—Samuel Meerkreebs

[57] ABSTRACT

A merchandising unit comprises a structure having a rear display panel and two side spaced-apart parallel panels joined to the rear panel at upstanding columns and further upstanding columns extending at the outer edges of the side panels. A rectangular frame is provided at the top of the structure for maintaining the stability thereof. A wire grid forms the rear and side panels which define a vaulted space, and display trays and/or shelves having hook brackets are hung from the rear panel within the vaulted space, and similar display devices having hook brackets are hung from the side panels on the surface away from the vaulted space.

4 Claims, 3 Drawing Sheets

MERCHANDISING UNIT

BACKGROUND OF THE INVENTION

1. Field of the Invention

The present invention relates to a merchandising unit, and more particularly, to a space-saving, self-supporting, merchandising stand.

2. Description of the Prior Art

Pegboard-type merchandising units, such as wall-mounted boards, are well known. These may be in the form of slatwalls, pegboards, wire grids, etc., to which shelves, baskets, or display racks are provided, supplied with suitable handling brackets for mounting to the board. Examples of such merchandising systems can be found in U.S. Pat. Nos. 3,669,034, Marschak, 1972; 4,322,006, Marschak, 1982; 4,511,047, Elinsky, 1985; and 4,905,846, Calvert, 1990. These patents are mentioned as representative of the class of goods in which the present subject matter belongs Such display or merchandising systems are generally found in retail stores and are meant to cover vertical wall space and are not generally self-supporting.

U.S. Pat. No. 4,944,390, Baucom et al, 1990, suggests a self-supporting merchandising unit comprising a pegboard-type wall segment with support frame members for supporting the pegboard in an upright position as well as for supporting shelves associated with the pegboard.

SUMMARY OF THE INVENTION

It is an aim of the present invention to provide a self-supporting merchandising unit of the type having several display panels adapted to receive article holding means provided with hanging brackets It is a further aim of the present invention to provide a merchandising unit which is space saving yet is as accessible as any wall-mounted vertical display area.

A construction in accordance with the present invention includes a merchandising unit comprising a first upstanding planar display panel, at least second and third upstanding display panels each connected to and extending at an angle from the first display panel and spaced apart from each other to form a vaulted space therewith, the first display panel having an accessible display surface at least on the side within the vaulted space and each second and third display panel having accessible display surfaces at least on the sides thereof opposite the vaulted space, and means for maintaining the angular and spaced relationship of the first, second, and third panels and to maintain the self-supporting structural integrity of the merchandising unit.

In a more specific embodiment of the present invention, there is provided a merchandising unit having the display panels provided with a consistent pattern of small openings and the display panel suitable for receiving shelving or other display devices provided with mounting brackets. Such a display panel may be a pegboard type or grid made up of wire rod construction. Each merchandising unit may be arranged in pairs, back to back.

The merchandising unit in accordance with the present invention can be set up almost anywhere in a retail outlet including in the center of the corridor. The merchandising unit is self-supporting but also presents several display surfaces which increase the vertical display area available per square horizontal footage For instance, bulk dispensers provided with proper brackets can be placed on the display panel within the vaulted space while further products, either bulk items or blister package items hung from arms, can be placed on the display panels on each side facing away from the vaulted space. If necessary, a pair of back-to-back merchandising unit modules can be set up so that all exposed panels can be utilized to the maximum for displaying the various products and dispensing trays having brackets for mounting onto the display panels.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
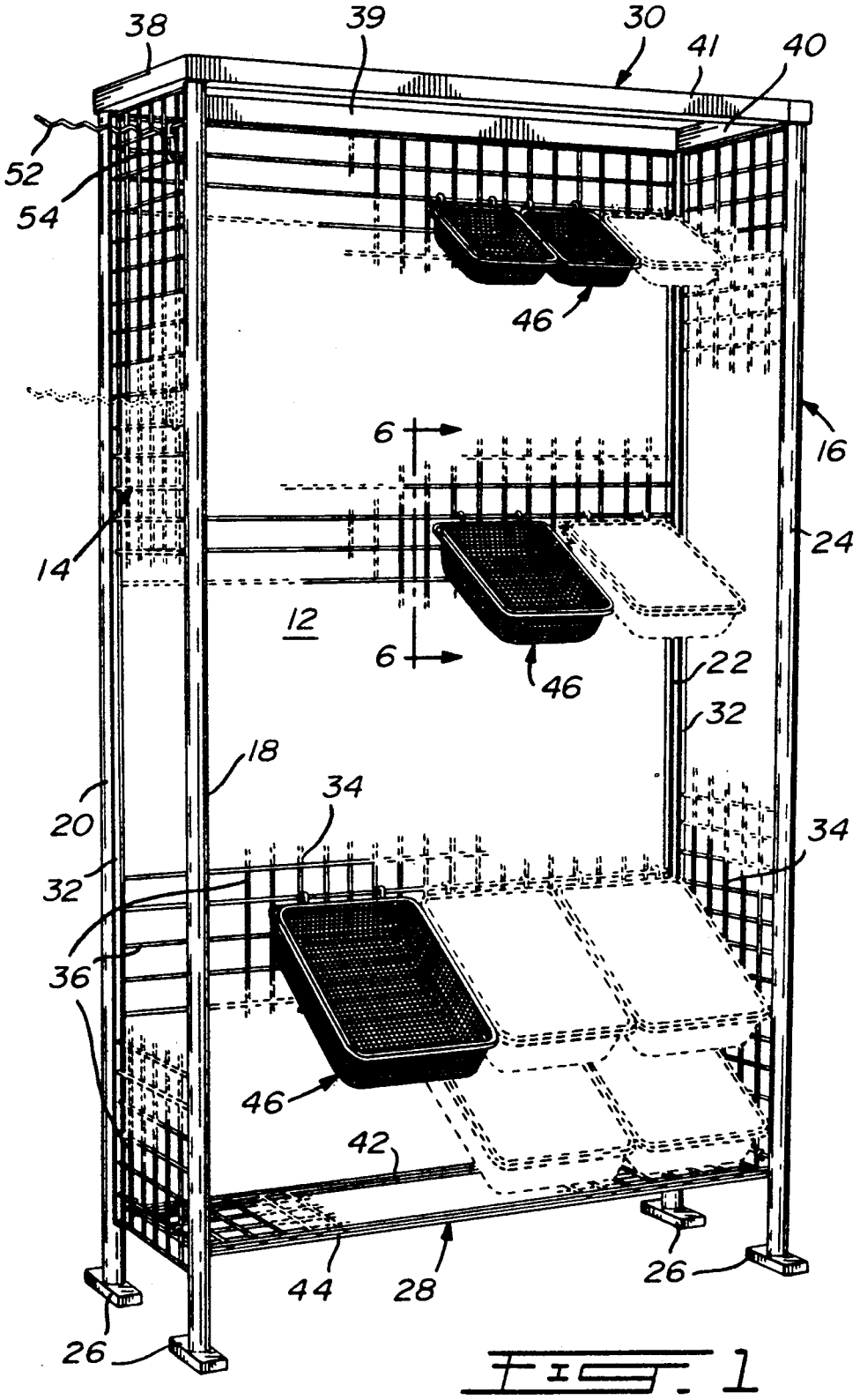
FIG. 1 is a perspective view of an embodiment in accordance with the present invention.
Figure 2:
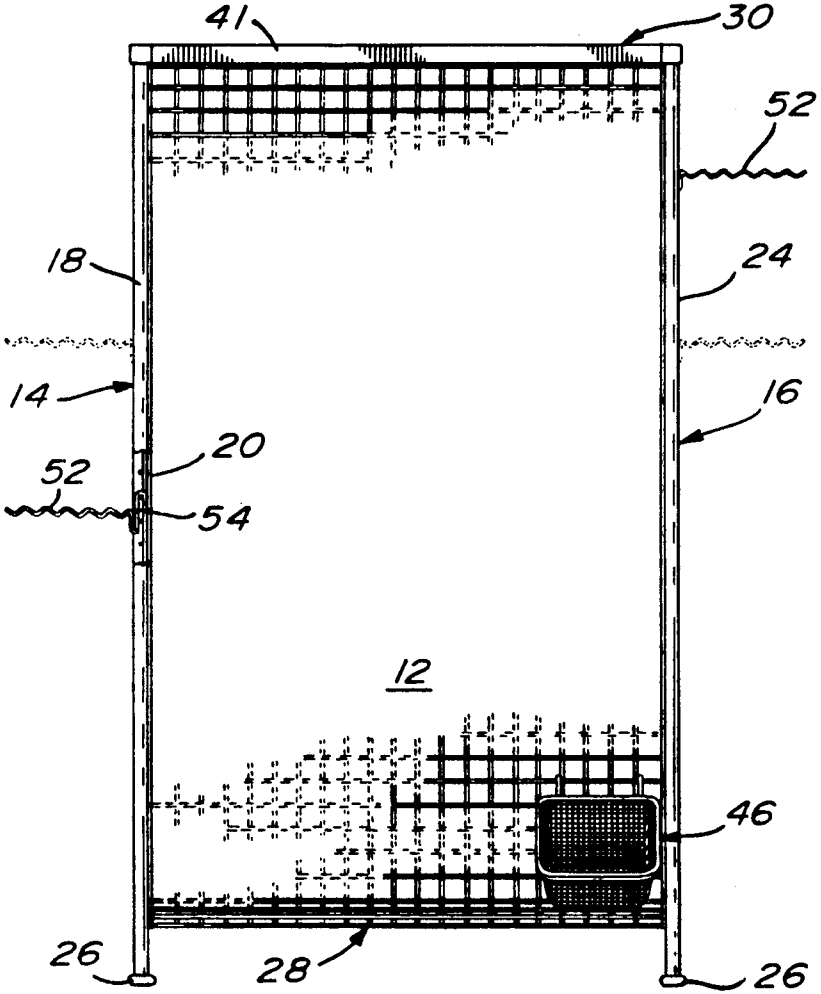
FIG. 2 is a front elevation thereof.
Figure 3:
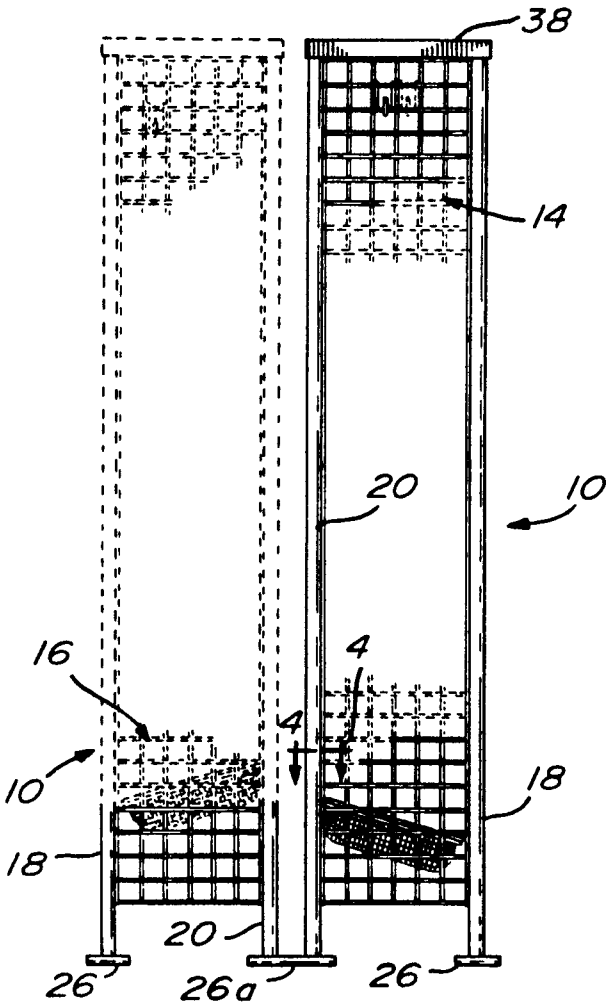
FIG. 3 is an end elevation of the device shown in FIG. 1 and showing a second similar device set up back to back.

As shown in FIGS. 1 to 3, the merchandising unit 10 is provided with a rear panel 12. In the embodiment illustrated, the display panels are made up of a wire grid having a mesh size sufficient to receive brackets having bent-over hooks. The panels, however, could be the pegboard type, even a slatwall construction, all of which are adapted to receive shelving, display trays, or hanging arms provided with brackets and avoiding the need to utilize fasteners for mounting the display devices The merchandising unit 10 shown in FIGS. 1 to 3 also includes side display panels 14 and 16 extending from the edges of the rear display panel 12 and at right angles thereto to form a vaulted space therebetween.

Figure 4:
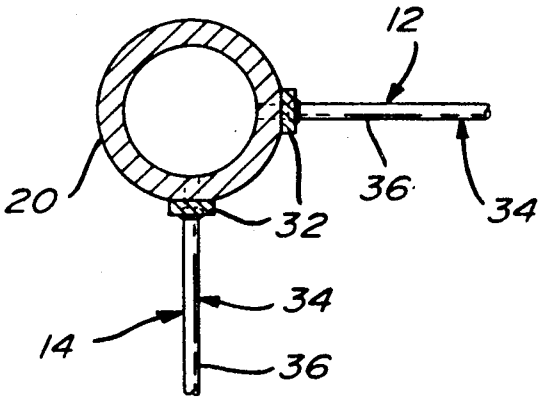
FIG. 4 is a horizontal cross-section, taken along line 4—4 of FIG. 3.
Figure 5:
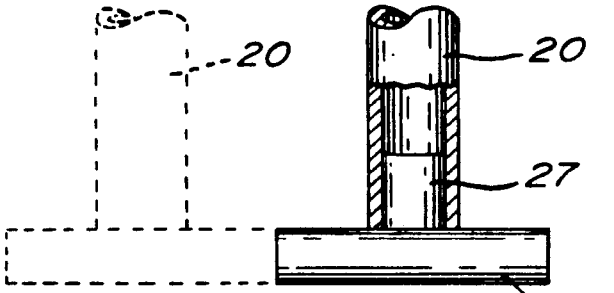
FIG. 5 is a fragmentary enlarged elevation, partly in cross-section, of a detail of the device shown in FIG. 1.

The merchandising unit 10 has columns 18, 20, 22, and 24 at each corner thereof. Each column of the present embodiment is a hollow circular cylindrical tube of suitable weight-bearing material, such as steel. The columns 18 through 24 include feet 26, such as shown in FIG. 5. Each foot 26 includes an upstanding lug which tightly fits within the cylindrical tube forming the columns In this case, column 20 is illustrated in FIG. 5. At the top of the merchandising unit, there is provided a rectangular frame 30 made up of square tubing members 38, 39, 40, and 41, joined together and connected to the tops of columns 18, 20, 22, and 24 to provide structural stability thereto. Likewise, a bottom wall 28 extends between the lower portions of the columns in order to add structural stability to the merchandising unit and possibly to provide a further display shelf In the present embodiment, the wire grid 34 is made up of mesh wire rods 36, the ends of which are welded to a thin, narrow frame 32 fastened or welded to the respective columns 18, 20, 22, and 24. A corner assembly of the grid members 34 is illustrated in FIG. 4. The structural stability and weight-bearing capacity is also dependent on the display panels, in this case, the wire grids 34 integral with the columns and the frames 30 and bottom wall 28.

As such, the merchandising unit 10 is selfsupporting and can be located anywhere on a flat floor surface, either against the wall or in an open area such as a wide corridor.

Figure 6:
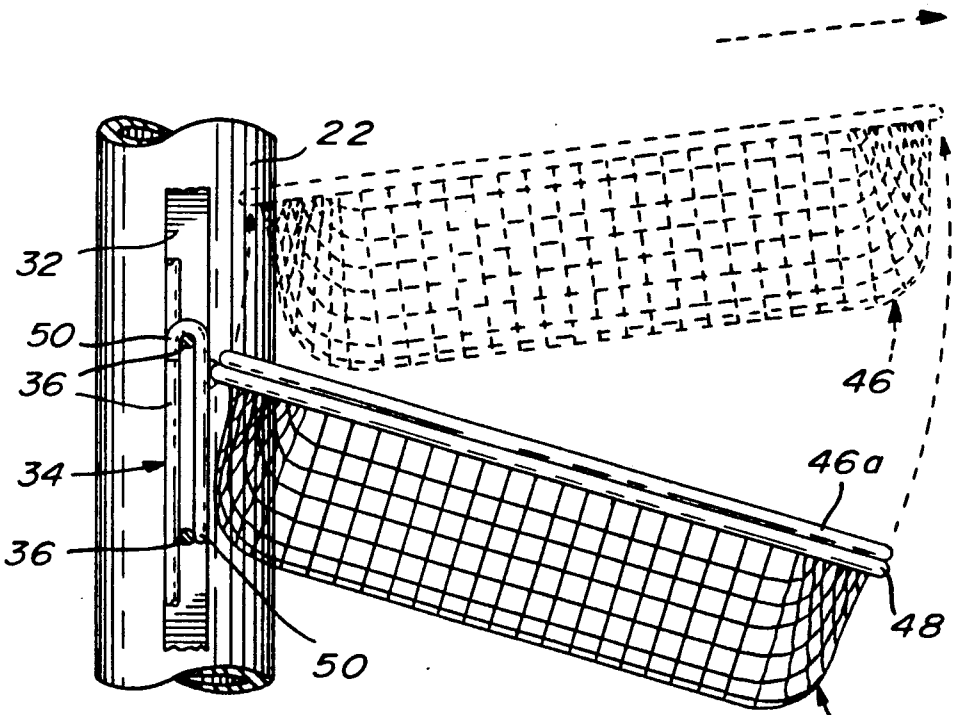
FIG. 6 is a fragmentary vertical crossfurther section, taken along line 6—6 of FIG. 1, showing a detail thereof.

As illustrated in FIGS. 1 and 6, display trays in the form of a wire mesh basket 46 are supported on the rear display panel 12. Each tray 46 includes an upper peripheral rim 46*a* which sits on a holder 48. The holder 48 is welded at 56 to a hanging bracket 54. In this case, the hanging bracket 54 has a bent-over hook 50 adapted to engage on the wire rods 36 of the grid 34. The bracket 50 also has a downward extension, as shown in FIG. 6, to abut against an adjacent lower wire rod 36 of the grid 34 in order to provide proper support for the cantilevered tray 46 which may be filled with bulk items including household wares.

The embodiment in FIGS. 1 and 2 shows display arms 52 extending outwardly of the display panels 14 and 16. Other types of display devices could also be utilized on the outside surfaces of the display panels 14 and 16, such as trays 46, etc. Display devices would not normally extend inwardly of the vaulted space on display panels 14 and 16 so as not to interfere with the display devices extending from the rear display panel 12. On the other hand, similar display devices could be mounted to the rear display panel 12 but extending on the opposite side from the vaulted space.

Preferably, another module similar to merchandising unit 12 can be set up back to back as shown in FIG. 3. In order to arrange the back-to-back setup of the merchandising units 10, a common foot 26*a* can be provided for columns 20 of each merchandising unit 10, for instance. In this way, a merchandising island is provided with display surfaces in all quadrants.

I claim:

1. A merchandising unit comprising a first upstanding planar display panel, vertical weight bearing columns at each vertical edge of the first display panel, a second and third display panel extending from respective ones of said vertical weight bearing columns, the second and third display panel extending at right angles to the first panel and on the same side thereof to form a vaulted space therewithin, a vertical weight bearing column located at each respective other vertical edge of the second and third display panels, a rectangular frame located at the top of the merchandising unit and connected to each vertical weight bearing column at a respective corner of the rectangular frame to maintain the merchandising unit in a self supporting integral unit, each first, second and third display panel including an open grid for receiving on either face, display devices provided with mounting brackets engageable within the open grid of each display device such that the display devices are accessible within the vaulted space and on the faces of the display panels facing outwardly of the vaulted space.

2. A combined pair of merchandising units wherein each merchandising unit as defined in claim 1 is set back to back so that the outwardly facing faces of the respective first display panels are adjcent one another, and the vertical weight bearing columns on each vertical edge of the first panels are provided with shoes joining adjcent respective ones of the columns.

3. A merchandising unit as defined in claim 1 wherein the display surface has openings for receiving a hook-type bracket, the display device including a holder in the form of a frame member defining a closed loop, the display device including a ray having a bottom wall and upstanding side walls, and a rim defined at the top of the side walls, and the rim being adapted to be supported on the frame member forming the closed loop.

4. A merchandising unit as defined in claim 1, wherein the display panel open grid includes a wire grid.

* * * * *